US010807098B1

(12) United States Patent
Sandnes et al.

(10) Patent No.: US 10,807,098 B1
(45) Date of Patent: Oct. 20, 2020

(54) SYSTEMS AND METHODS FOR STEP GRINDING

(71) Applicant: PEARSON INCORPORATED, Sioux Falls, SD (US)

(72) Inventors: Blake Sandnes, Sioux Falls, SD (US); Alex Pearson, Sioux Falls, SD (US); Roy Olson, Sioux Falls, SD (US); Josh Tracy, Harrisburg, SD (US)

(73) Assignee: Pearson Incorporated, Sioux Falls, SD (US)

( * ) Notice: Subject to any disclaimer, the term of this patent is extended or adjusted under 35 U.S.C. 154(b) by 335 days.

(21) Appl. No.: 16/013,339

(22) Filed: Jun. 20, 2018

Related U.S. Application Data

(60) Provisional application No. 62/537,318, filed on Jul. 26, 2017.

(51) Int. Cl.
*B02C 13/284* (2006.01)
*B02C 23/08* (2006.01)
*B02C 23/16* (2006.01)

(52) U.S. Cl.
CPC ..... *B02C 13/284* (2013.01); *B02C 23/08* (2013.01); *B02C 2023/165* (2013.01)

(58) Field of Classification Search
CPC . B02C 2013/28663; B02C 4/286; B02C 4/32; B02C 13/286; B02C 2013/28618
See application file for complete search history.

(56) References Cited

U.S. PATENT DOCUMENTS 254,974 A 3/1882 Hollingsworth
417,836 A 12/1889 Ponsar
454,950 A 6/1891 Sewell
(Continued)

FOREIGN PATENT DOCUMENTS

CN 207385669 5/2018
DE 4120456 A1 * 12/1992 ..... B02C 13/286
(Continued)

OTHER PUBLICATIONS

Greiner, Translation of DE-4120456-A1 (Year: 1992).*
(Continued)

*Primary Examiner* — Adam J Eiseman
*Assistant Examiner* — Bobby Yeonjin Kim
(74) *Attorney, Agent, or Firm* — Jeffrey A. Proehl; Woods, Fuller, Shultz & Smith, PC

(57) ABSTRACT

A method and apparatus for grinding a particulate material is disclosed. The method may include providing a system including a roller mill apparatus and a hammermill apparatus, operating the roller mill apparatus and the hammermill apparatus, adjusting a feed rate of particulate material to the roller mill apparatus until power consumption by operation of the roller mill apparatus achieves a target power consumption for the roller mill apparatus, and adjusting a gap between mill rolls of the roller mill apparatus until power consumption by operation of the hammermill apparatus achieves a target power consumption for the hammermill apparatus. The system may include roller and hammermill apparatus with sensing and controlling apparatus configured to operate the roller and hammermill apparatus according to the methods disclosed.

5 Claims, 8 Drawing Sheets

(56) References Cited

U.S. PATENT DOCUMENTS 473,957 A 5/1892 Pollock
621,744 A 3/1899 Bowden
664,836 A 1/1901 Davidson
738,166 A 9/1903 Davidson
1,466,508 A 8/1923 Lake
1,568,267 A 1/1926 Carter
1,611,675 A 12/1926 Prestmon
1,940,531 A * 12/1933 Bullock ..... B02C 13/286 198/624
2,053,038 A 9/1936 MacKenzie
2,118,010 A 5/1938 Hazle, Jr.
3,226,041 A 12/1965 Graumann
3,304,355 A 2/1967 Pobst, Jr.
3,362,649 A 1/1968 Odden
3,683,559 A 8/1972 Kalwaites
3,752,315 A 8/1973 Hubach
4,088,273 A * 5/1978 Jakobs ..... B02C 4/32 241/185.5
4,165,280 A 8/1979 Holley
4,177,900 A 12/1979 Kluthe
4,202,629 A 5/1980 Jakobs
4,213,855 A 7/1980 Vonbennigsen-Mackiewicz
4,218,414 A * 8/1980 Hagg ..... B02C 4/00 264/115
4,361,476 A 11/1982 Brewer
4,387,552 A 6/1983 Lancaster
4,442,876 A 4/1984 Koike
4,468,265 A 8/1984 MacLaughlin
4,608,156 A 8/1986 Reddish
4,645,484 A 2/1987 Niske
4,650,129 A * 3/1987 Newell ..... B02C 13/28 241/185.5
4,786,001 A 11/1988 Ephraim
4,862,570 A 9/1989 Bald
4,941,290 A 7/1990 Holyoke
4,986,997 A 1/1991 Posner
5,052,088 A 10/1991 Hagewood
5,100,062 A 3/1992 Baltensperger
5,115,984 A 5/1992 Satake
5,192,028 A 3/1993 Curran
5,201,470 A * 4/1993 Baltensperger ..... B02C 4/06 241/13
5,213,273 A * 5/1993 Linnerz ..... B02C 13/284 241/285.3
5,251,144 A 10/1993 Ramamurthi
5,315,789 A 5/1994 Takashi
5,366,167 A 11/1994 McCarthy
5,392,998 A 2/1995 Suessegger
5,501,629 A 3/1996 Kawana
5,523,701 A 6/1996 Smith
5,533,371 A 7/1996 Frischknecht
5,717,209 A 2/1998 Bigman
6,176,683 B1 1/2001 Yang
6,199,777 B1 3/2001 Satake
6,293,478 B1 9/2001 Livieri
6,365,416 B1 4/2002 Elsohly
6,372,281 B1 4/2002 Metzger
6,443,376 B1 9/2002 Huang
6,517,016 B1 2/2003 Feige
6,589,598 B2 7/2003 Ochiai
6,730,519 B2 5/2004 Elsohly
6,990,431 B2 1/2006 Beaudoin
7,006,953 B2 2/2006 Takemura
7,083,544 B2 8/2006 Goransson
7,170,251 B2 1/2007 Huang
7,183,735 B2 2/2007 Heinemann
7,206,719 B2 4/2007 Lindsay
7,381,017 B2 6/2008 Wang
7,419,694 B2 9/2008 Korolchuk
7,425,344 B2 9/2008 Korolchuk
7,540,697 B2 1/2009 Wang
7,568,641 B2 8/2009 Dreimann
7,592,468 B2 9/2009 Goodwin
7,756,678 B2 7/2010 Bonissone
7,832,241 B2 11/2010 Mantovan
8,144,005 B2 3/2012 Hu
8,206,061 B1 6/2012 Hansen
8,211,341 B2 7/2012 Lustiger
8,343,553 B2 1/2013 Hospodor
8,485,052 B2 7/2013 Gebhart
8,690,087 B2 4/2014 Holl
8,734,143 B2 5/2014 Morris
8,842,267 B2 9/2014 Heine
9,066,910 B2 6/2015 Rosenblatt
9,104,650 B2 8/2015 Hosek
9,604,226 B2 3/2017 Storm
9,649,349 B1 5/2017 Tucker
9,651,467 B2 5/2017 Deguchi
9,694,040 B2 7/2017 Scialdone
9,788,770 B1 10/2017 Belthangady
9,795,338 B2 10/2017 Kang
9,797,822 B2 10/2017 Little, III
9,801,956 B2 10/2017 Kularatne
9,803,063 B2 10/2017 Reddy
9,804,092 B2 10/2017 Zeng
9,808,538 B2 11/2017 Kularatne
9,919,315 B2 3/2018 Pearson
9,959,514 B2 5/2018 Phan
9,974,821 B2 5/2018 Kennedy
2002/0022899 A1 2/2002 Dehy
2002/0168911 A1 11/2002 Tonner
2003/0017426 A1 1/2003 Schmidt
2004/0096585 A1 5/2004 Bonnebat
2006/0073258 A1 4/2006 Korolchuk
2006/0231021 A1 10/2006 Friske
2007/0170291 A1 7/2007 Naganawa
2007/0241218 A1* 10/2007 Peterson ..... B02C 13/286 241/73
2007/0294121 A1 12/2007 Galt
2008/0063330 A1 3/2008 Orlowski
2008/0167483 A1 7/2008 Whittle
2008/0203956 A1 8/2008 Cohen
2008/0275660 A1 11/2008 Bhateja
2009/0093191 A1 4/2009 Glide
2009/0295561 A1 12/2009 Hu
2010/0030926 A1 2/2010 Boussy
2010/0059609 A1 3/2010 Teeter
2010/0127217 A1 5/2010 Lightowlers
2011/0067374 A1 3/2011 James
2011/0276828 A1 11/2011 Tamaki
2012/0005017 A1 1/2012 Lowden
2012/0244266 A1 9/2012 Ku
2013/0087644 A1 4/2013 Ephraim
2013/0271110 A1 10/2013 Yamanaka
2013/0301375 A1 11/2013 Stephan
2014/0014748 A1 1/2014 Zeeck
2014/0048459 A1 2/2014 Hafford
2014/0145018 A1 5/2014 Niklewski
2014/0245799 A1 9/2014 Kim
2014/0299688 A1 10/2014 Carbonini
2015/0001323 A1* 1/2015 Rikkonen ..... B02C 13/095 241/5
2015/0129698 A1 5/2015 Olson
2015/0211971 A1 7/2015 Little, III
2015/0300800 A1 10/2015 Van Valkenburgh
2015/0324759 A1 11/2015 Bansal
2015/0346717 A1 12/2015 Hosek
2017/0080466 A1 3/2017 Godwin
2017/0131194 A1 5/2017 Little, III
2017/0246640 A1* 8/2017 Wagner ..... B02C 13/286
2017/0333257 A1 11/2017 Schmitz

FOREIGN PATENT DOCUMENTS

DE 102005055373 5/2007
EP 1195668 9/2002
JP 2010201440 9/2010
WO 2005119089 12/2005
WO 2007066847 6/2007

(56) References Cited

FOREIGN PATENT DOCUMENTS

| | | |
|---|---|---|
| WO | 2010082322 | 7/2010 |
| WO | 2017051398 | 3/2017 |

OTHER PUBLICATIONS

Charles Stark and Julie Kalivoda, "Evaluating Particle Size of Feedstuffs", publication, Nov. 2016, 4 pages, K-State Research and Extension, Kansas State University Agricultural Experiment Station and Cooperative Extension Services, Manhattan, Kansas.

* cited by examiner

SYSTEMS AND METHODS FOR STEP GRINDING

REFERENCE TO RELATED APPLICATIONS

This application claims the benefit of U.S. Provisional Patent Application No. 62/537,318, filed on Jul. 26, 2017, which is hereby incorporated by reference in its entirety.

BACKGROUND

Field

The present disclosure relates to grinding apparatus and more particularly pertains to a new system and method for step grinding having increased operational power efficiency.

SUMMARY

In one aspect, the present disclosure relates to a system for grinding particulate material which may comprise a roller mill apparatus including a pair of rotatable grinding mill rolls to grind particulate material, with the pair of mill rolls being positioned adjacent to each other in a manner defining an adjustable gap therebetween for the passage of the particulate material therethrough. The roller mill apparatus may include at least one roller mill motor connected to at least one of the mill rolls to rotate the mill roll. The system may also include a hammermill apparatus including a rotatable rotor and a plurality of hammers mounted on the rotor to shred the particular material passing through the hammermill apparatus, with the hammermill apparatus including a hammermill motor connected to the rotor to rotate the rotor and hammers. The system may further include a control apparatus controlling operation of elements of the roller mill apparatus and the hammermill apparatus, and the control apparatus may be configured to adjust a feed rate of particulate material to the roller mill apparatus to cause power consumption by operation of the roller mill apparatus to move toward a target power consumption for the roller mill apparatus. The control apparatus may also be configured to adjust a gap between mill rolls of the roller mill apparatus to cause power consumption by operation of the hammermill apparatus to move toward a target power consumption for the hammermill apparatus.

In another aspect, the present disclosure relates to a method of grinding a particulate material including providing a system including a roller mill apparatus and a hammermill apparatus, operating the roller mill apparatus and the hammermill apparatus, adjusting a feed rate of particulate material to the roller mill apparatus until power consumption by operation of the roller mill apparatus achieves a target power consumption for the roller mill apparatus, and adjusting a gap between mill rolls of the roller mill apparatus until power consumption by operation of the hammermill apparatus achieves a target power consumption for the hammermill apparatus.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and the particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
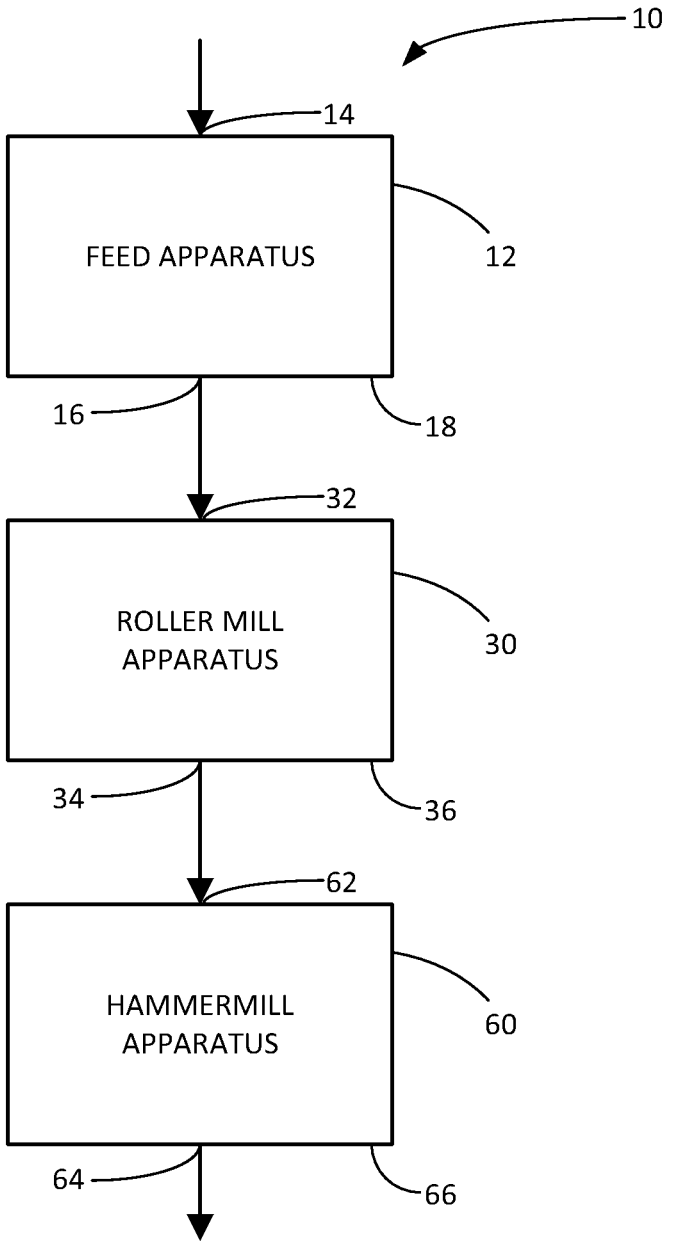
FIG. 1 is a schematic block diagram of a new step grinding system according to the present disclosure.
Figure 2:
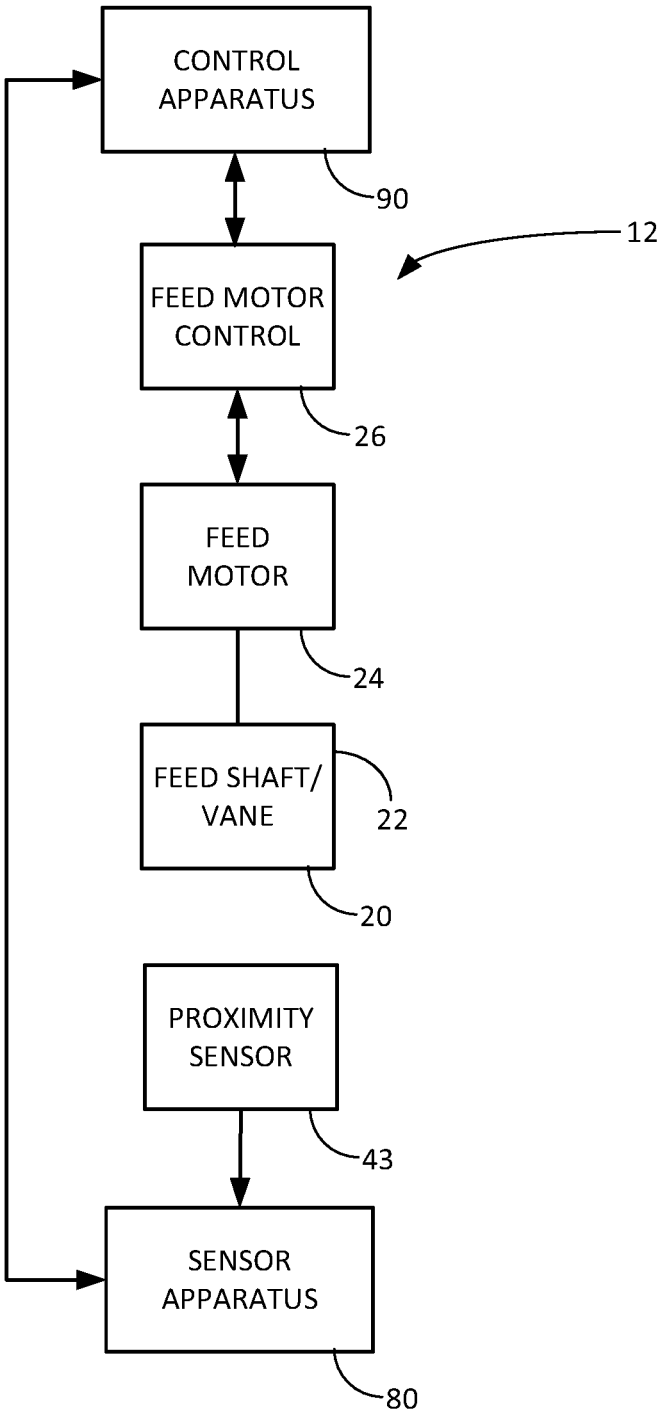
FIG. 2 is a schematic block diagram of the feed apparatus of the step grinding system, according to an illustrative embodiment.
Figure 3:
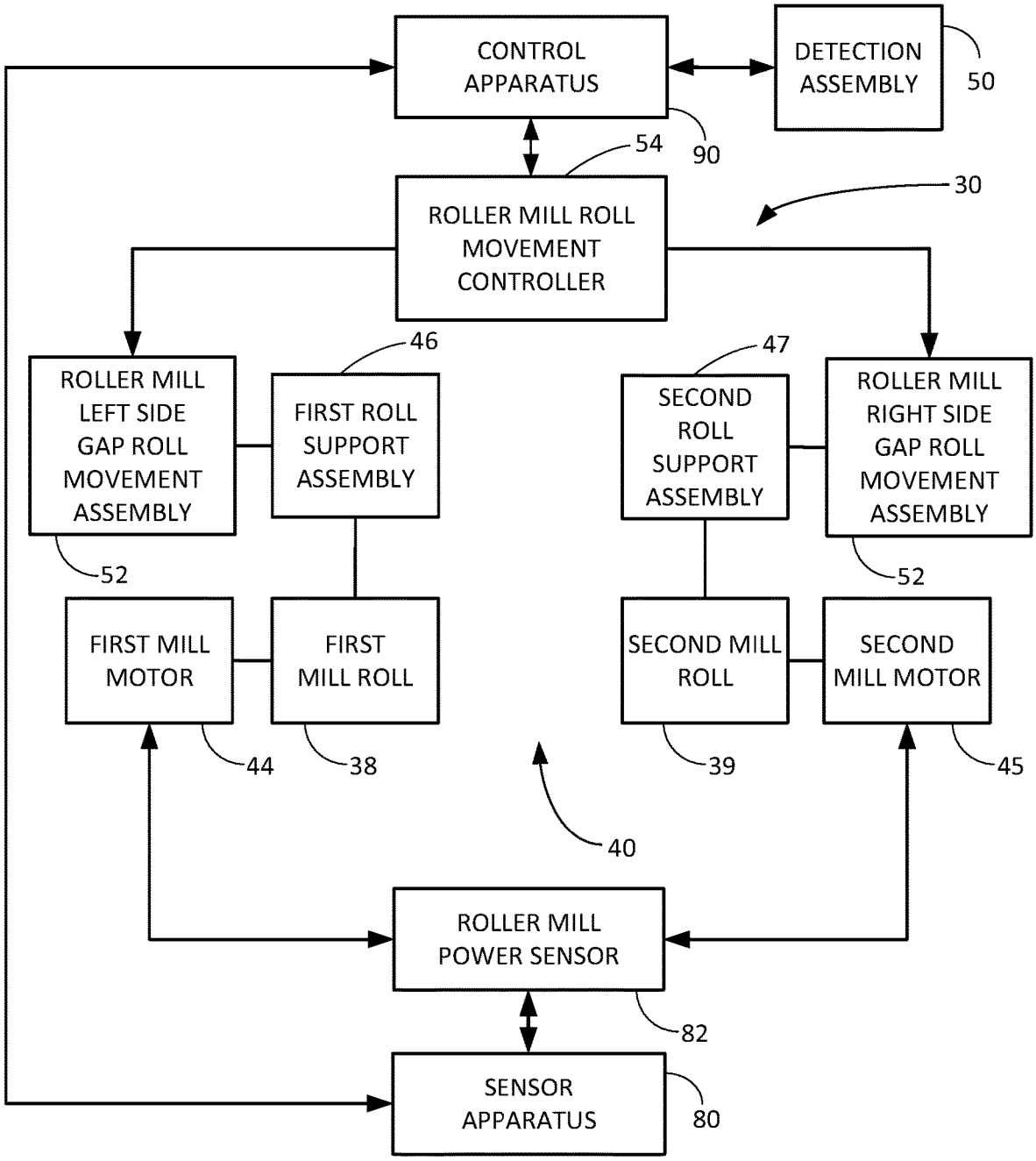
FIG. 3 is a schematic block diagram of the roller mill apparatus of the step grinding system, according to an illustrative embodiment.
Figure 4:
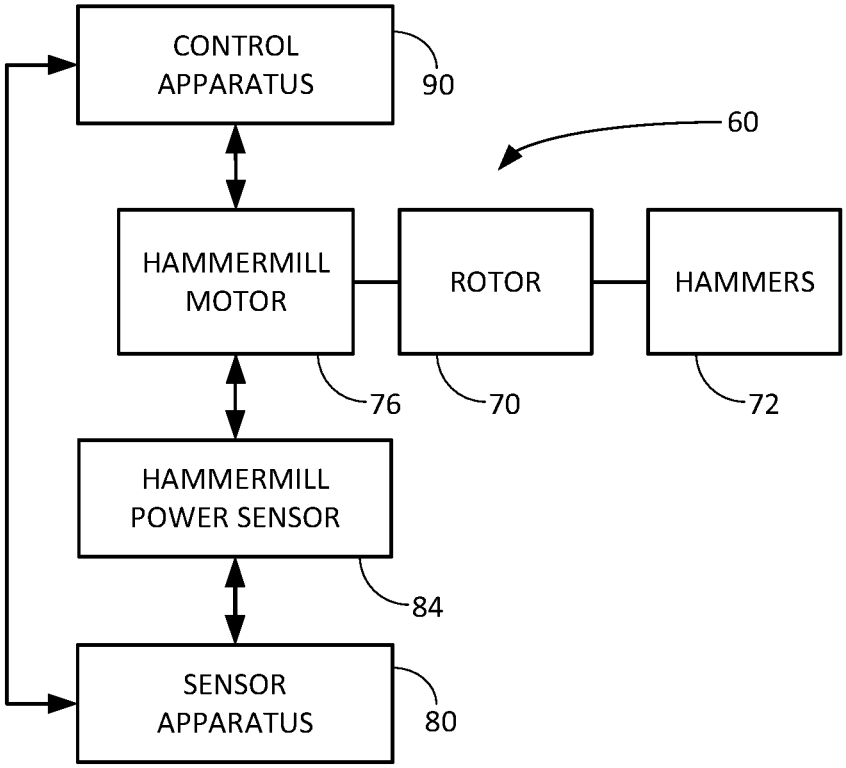
FIG. 4 is a schematic block diagram of the hammermill apparatus of the step grinding system, according to an illustrative embodiment.

With reference now to the drawings, and in particular to FIGS. 1 through 7 thereof, a new system and method of step grinding embodying the principles and concepts of the disclosed subject matter will be described.

The applicants have recognized that grinding a particulate material, such as corn, to a relatively fine size (for example, approximately 250 microns) in large flow capacities using a hammermill apparatus requires a significant amount of horsepower input applied to the hammermill. Typically, hammermills operate most efficiently when the motor of the hammermill is operating at approximately 100 percent of the rated amperage, but this operating condition can be difficult to maintain when the particulate material includes different grains and grains having varying moisture content. In addition to the significant power requirements for this operation, the wear on parts of the hammermill apparatus, such as the filtering screen which sets the particle size for the output of the mill, can be significant.

The applicants have also recognized that step grinding, which involves initial milling using a roller mill and then later milling with a hammermill, is an improvement in the milling process to reach the desired small ground particle size and the desired high material throughput. The roller mill apparatus initially breaks down the grain particle to an intermediate size and the hammermill is able to grind the intermediate particles to the final size, such as 250 microns. However, the variation in conditions, such as the grinding of different grains and varying moisture content, still makes it difficult to achieve the highest operational efficiency of the hammermill at approximately 100 percent of full load amperage.

The applicants have devised a step grinding system which may include a roller mill apparatus and a hammermill apparatus, and in some embodiments a feed apparatus to control the feed rate of material into the roller and hammermill apparatus, and may utilize a method that causes the hammermill to operate at a loading that provide the most efficient operation of the hammermill, such as in terms of power required per quantity of grain milled. Illustratively, the motor operating the hammermill would be operated at substantially full power (or approximately 100 percent of full load amperage) and the motor operating the roller mill would be operated at close to or above approximately 90 percent of the full load amperage for the motor.

In one aspect, the disclosure is directed to a system 10 for grinding particulate material into smaller sizes. The particulate material may suitably comprise a grain, such as corn, wheat, soybeans, for example, but may also include other materials suitable for milling into smaller size particles using roller and/or hammermills.

In some embodiments, system 10 may include a feed apparatus 12 which is configured to receive particulate material and control the feed rate of the particulate material moving through the system 10. The feed apparatus 12 may include a feed input opening 14 into which the particulate material is received into the feed apparatus, and a feed output opening 16 from which particulate material exits the feed apparatus. Typically, the particulate material entering the input opening 14 and leaving the output opening 16 will be approximately the same size without any milling or crushing or processing of the particulate material occurring in the feed apparatus that would reduce the size of the material. Optionally, the feed apparatus 12 may be bypassed or eliminated from the system.

The feed apparatus 12 may include a feed apparatus frame 18 which may define the feed input opening 14 and the feed output opening 16. In some embodiments, the feed input opening 14 and feed output opening 16 may be substantially vertically aligned with each other. The feed apparatus 12 may also include a rotating shaft 20 which is rotatably mounted on the apparatus frame 18, such as by bushings or bearings or other suitable structure. In some embodiments, the rotating shaft 20 may be located substantially between the input opening 14 and the output opening 16. The feed apparatus may also include a plurality of vanes 22 which extend outwardly from the rotating shaft 20 in a substantially radial manner or orientation. The vanes 22 may be mounted on the shaft so that the vanes rotate with the shaft and relative to the feed apparatus frame 18. Spaces between the vanes may catch particulate material entering the feed input opening 14 and dispense the particulate material to the feed output opening 16 as the shaft and vanes rotate with respect to the frame 18. The speed of rotation of the shaft 20 and vanes 22 may thus control the rate at which particulate material moves through the feed apparatus between the input opening 14 and the output opening 16, and as a result faster rotation of the shaft and vanes results in a higher a relatively higher feed rate and slower rotation of the shaft and vanes results in a relatively lower feed rate.

The feed apparatus 12 may also include a feed motor 24 which may be mounted on the feed apparatus frame 18 and is connected to the rotating shaft 20 in a manner that permits the feed motor to cause rotation of the shaft 20 with respect to the frame 18. A feed motor control 26 may be configured to control the speed of operation of the feed motor and thereby the speed of rotation of the rotating shaft 20 to thereby control the feed rate of the feed apparatus.

The system 10 may also include a roller mill apparatus 30 which is configured to grind particulate material passing through the mill apparatus 30. The roller mill apparatus may have a roller mill input opening 32 through which the particulate material enters the roller mill apparatus and a roller mill output opening 34 through which the particulate material exits the roller mill apparatus. The roller mill apparatus may be configured to receive particulate material from the feed apparatus 12, and may be positioned below the feed apparatus to receive particulate material discharged by the feed apparatus under the influence of gravity. In some embodiments, the feed output opening 16 of the feed apparatus 12 may be in substantial alignment or registration with the roller mill input opening 32 of the roller mill apparatus. The roller mill apparatus 30 may include a roller mill frame 36 which may define the roller mill input opening 32 as well as the roller mill output opening 34. The roller mill input opening 32 may be located toward a top of the roller mill frame and the roller mill output opening 34 may be located at a bottom of the mill frame 36 and in some embodiments the input opening 32 and output opening 34 may be substantially vertically aligned.

The roller mill apparatus 30 may also comprise a pair of mill rolls 38, 39 which are mounted on the roller mill frame 36 for rotation about substantially parallel rotation axes. The mill rolls 38, 39 may be positioned adjacent to each other in a manner that defines a gap 40 therebetween through which the particulate material passes as the particulate material moves from the input opening 32 to the output opening 34. A width or size of the gap 40 between the pair of mill rolls may be adjustable. At least one of the mill rolls, and in some embodiments both of the mill rolls, have a plurality of teeth 42, and the teeth may extend in a generally longitudinal direction with respect to the mill roll in an orientation that is substantially parallel to the rotation axis of the respective roll. In some embodiments, the teeth may be substantially continuous between the opposite longitudinal ends of the mill roll or rolls. The apparatus may include a sensor 43, such as a proximity sensor, that senses or detects any significant buildup of particulate material adjacent to or between the mill rolls 38, 39 which indicates that the teeth on one or both of the rolls may be becoming dulled and requires sharpening or replacement of the roll. Dull rolls have more difficulty pulling the particulate material between the rolls and may cause the motors operating the rolls to not achieve a desired or target amperage. Based upon a signal from the sensor 43, the system may limit or decrease the speed of the feed motor and may warn the operator that the rolls need sharpening for optimal operation.

In some embodiments, one of the mill rolls is a stationary mill roll 38 that is mounted on the roller mill frame 36 in a manner that permits movement of the roll 38 with respect to the frame, and the second one of the mill rolls may be a stationary mill roll 39 which is mounted such that it is substantially stationary (although rotatable) with respect to the roller mill frame 36. The movable mill roll may be mounted on the roller mill frame in a manner that permits movement of the movable mill roll with respect to the stationary mill roll to adjust the width of the gap 40 between the movable and stationary rolls.

The roller mill apparatus 30 may also include at least one roller mill motor 44 which is connected to at least one of the mill rolls 38, 39 to rotate the mill roll or rolls. In some embodiments, the roller mill motor 44 is connected to both of the mill rolls through a series of belts and pulleys, and may cause rotation of the rolls at different speeds through the use of differently sized pulleys on the rolls. In some embodiments, a pair of roller mill motors 44, 45 may be mounted on the roller mill frame 36 and each may be connected to a respective mill roll to independently cause rotation of the rolls.

At least one movable roll support assembly 46 may be utilized on the roller mill apparatus 30 to support the movable mill roll 38 with respect to the roller mill frame 36. The movable mill roll support assembly 46 may be movably mounted on the roller mill frame to permit movement of the movable mill roll toward and away from the stationary mill roll to thereby adjust (e.g., make larger and smaller) the width or size of the gap 40. In some embodiments, a pair of movable roll support assemblies 46, 47 may be utilized with each of the assemblies 46, 47 supporting a respective end of the movable mill roll 39.

The roller mill apparatus 30 may further include a detection assembly 50 which is configured to detect a size or width of the gap 40 between the rolls. The detection assembly 50 may be configured to detect contact between the mill rolls, such as when the size of the gap is substantially zero. Any suitable means for determining the size of the gap may be utilized, and one highly suitable detection assembly is disclosed in U.S. non-provisional patent application Ser. No. 14/821,936 filed Aug. 10, 2015, which has a common assignee with the present application and is hereby incorporated by reference in its entirety.

The roller mill apparatus 30 may also include a roller mill roll movement assembly 52 which may be configured to operate the movable roll support assemblies 46, 47 to thereby cause the movable mill roll 39 to move with respect to the stationary mill roll 38 to thereby adjust the width or size of the gap 40. A roller mill roll movement controller 54 of the roller mill apparatus 30 may be in communication with the detection assembly 50 and may be configured to operate the roller mill roll movement assembly 52 to operate the support assemblies 46, 47 in order to set the width or size of the gap 40 between the mill rolls 38, 39.

The system 10 may also include a hammermill apparatus 60 which is configured to shred the particulate material passing through the apparatus 60. The hammermill apparatus 60 may have a hammermill input opening 62 and a hammermill output opening 64. The input opening 62 of the hammermill apparatus may receive particulate material from the roller mill apparatus, and the input opening 62 may be generally aligned with the roller mill output opening 34. The hammermill may be located vertically below the roller mill apparatus such that gravity assists the movement of the ground particulate material from the roller mill apparatus to the hammermill apparatus.

The hammermill apparatus 60 may include a hammermill frame 66 which defines a hammermill chamber 68, may also define the hammermill input opening 62 and the hammermill output opening 64. The hammermill chamber 68 may be in communication with the hammermill input opening 62 and the hammermill output opening 64. In some embodiments, the hammermill output opening 68 may be substantially vertically aligned with the hammermill input opening 62. A rotor 70 of the apparatus 60 may be positioned in the hammermill chamber 68 of the frame 66 and may be rotatably mounted on the frame 66 to thereby rotate in the chamber 68 with respect to the frame 66. The hammermill apparatus 60 may also include a plurality of hammers 72 which are mounted on the rotor 70 to rotate with the rotor. The hammers 72 may be pivotally mounted on the rotor and positioned in the hammermill chamber 68 to rotate in the chamber 68 with respect to the rotor. The hammermill apparatus 60 may also include a hammermill motor 76 mounted on the hammermill frame 66 and which is connected to the rotor 70 to rotate the rotor with respect to the frame 66 with the plurality of hammers 72. The hammermill apparatus 60 may have an appropriately sized screen to allow sufficiently ground particles to exit the chamber 68 while retaining in the chamber those particles that are larger than the desired size. The desired size of the ground particulate material may be, for example, approximately 250 microns in width.

The system may also include a sensor apparatus 80 which is configured to sense operational characteristics of the various elements of the system. The sensor apparatus 80 may be configured to sense power consumption by various elements of the system. The sensor apparatus 80 may include a roller mill power sensor 82 which is configured to sense the power draw by the roller mill motor or motors 44, 45 of the roller mill apparatus 30, and may be configured to sense an amperage level of the power draw by the roller mill motor or motors. The sensor apparatus 80 may also include a hammermill power sensor 84 which is configured to sense the power draw by the hammermill motor 76 of the hammermill apparatus 60, and may be configured to sense an amperage level of the power draw of the hammermill motor.

The system may also include a control apparatus 90 which may be configured to control operation of the roller mill apparatus 30 and the hammermill apparatus 60, as well as the feed apparatus 12. The control apparatus may be suitable for directing the various elements of the system to carry out various steps and actions set forth in this disclosure. The control apparatus 90 may be in communication with at least the sensor apparatus 80, including the roller mill power sensor, the hammermill power sensor, the feed motor control, the detection assembly of the roller mill apparatus, and the roller mill movement controller. Other elements may also be in communication with and be controlled by the control apparatus 90. It should be recognized that various control elements and sensor elements may be integrated together or separated from each other in various suitable configurations.

Figure 5A:
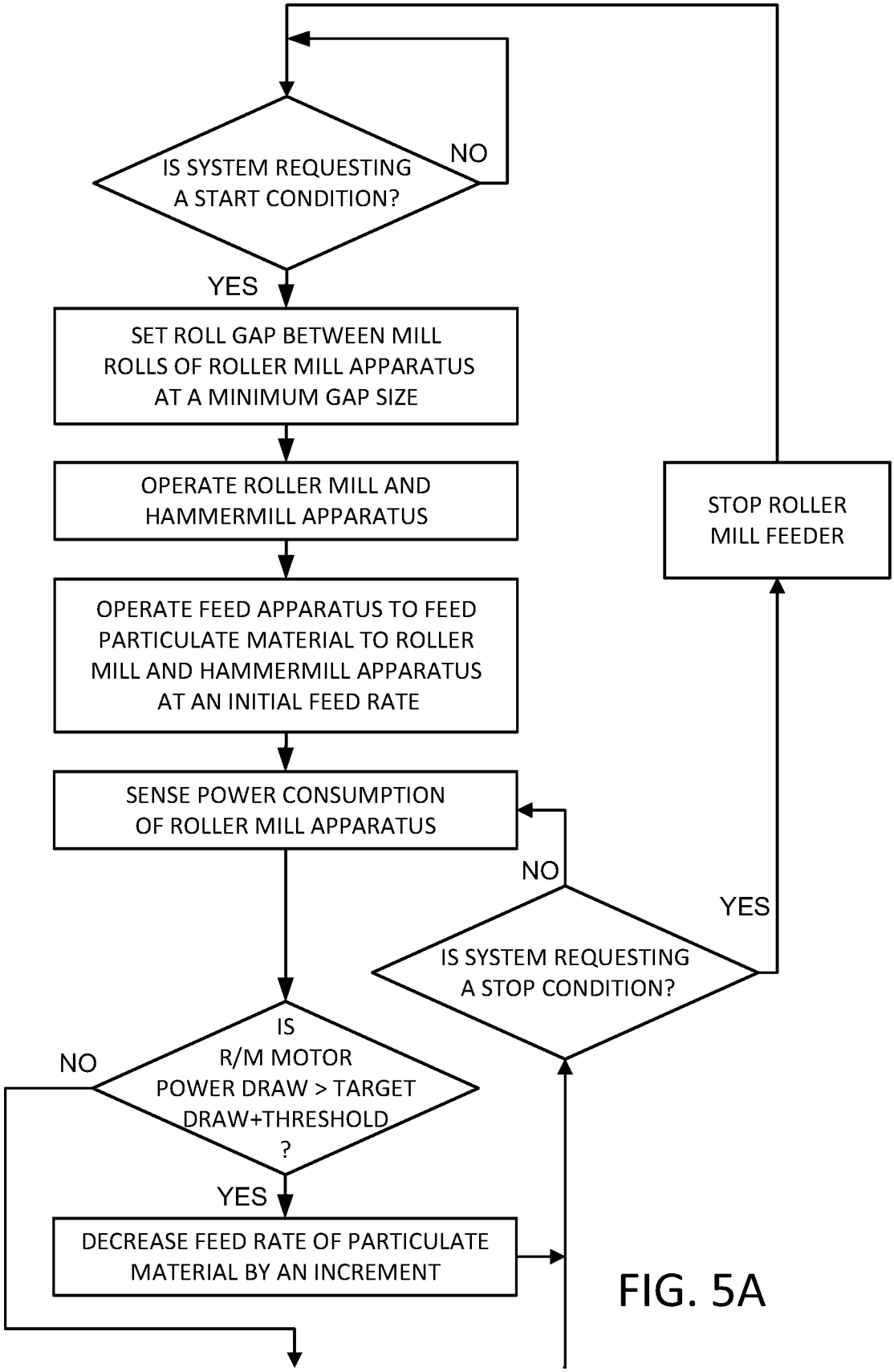
FIG. 5A is a schematic flow diagram of one portion of an illustrative implementation of a method of operation of a step grinding system.
Figure 5B:
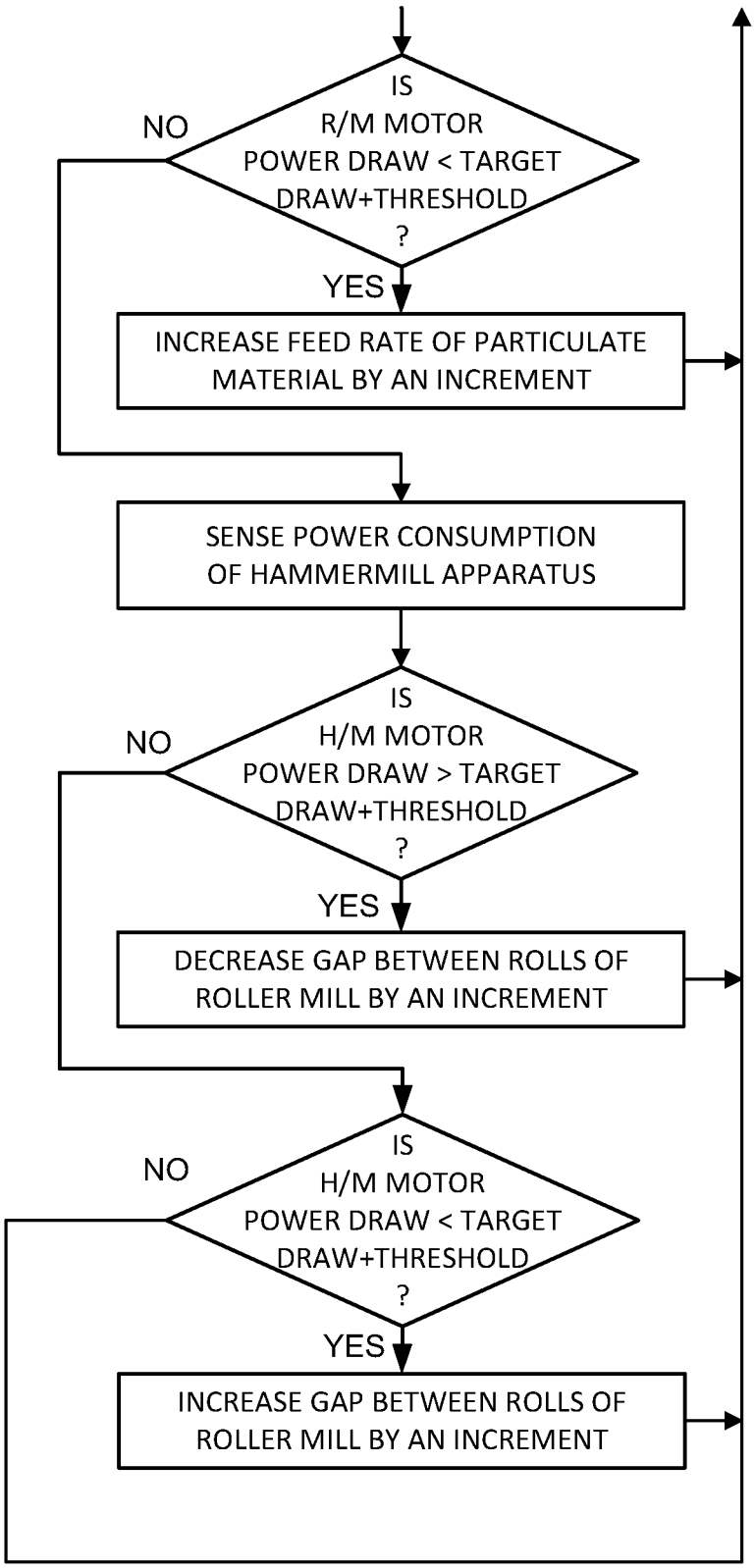
FIG. 5B is a schematic flow diagram of another portion of an illustrative implementation of a method of operation of a step grinding system.
Figure 6:
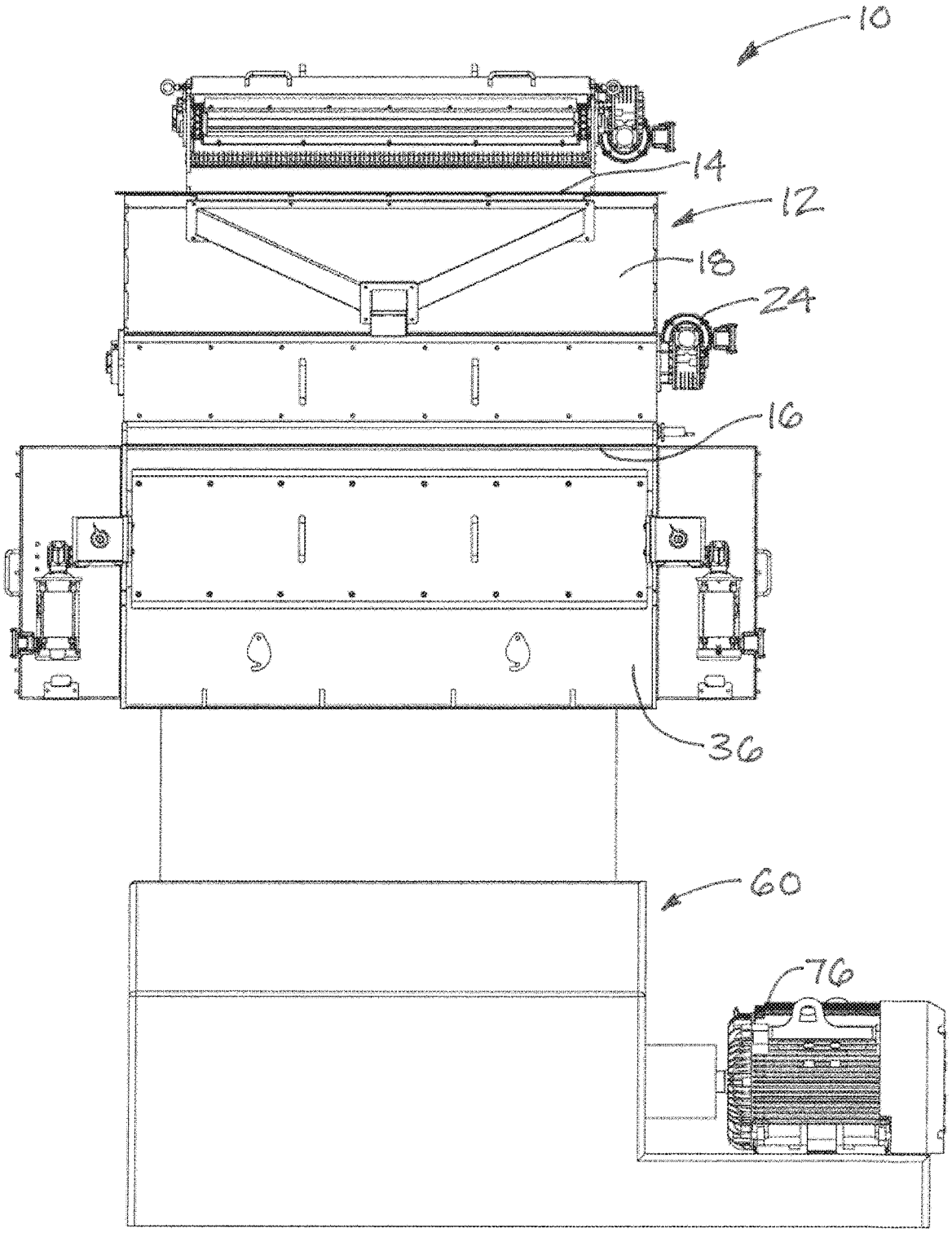
FIG. 6 is a schematic front view of the step grinding apparatus, according to an illustrative embodiment.
Figure 7:
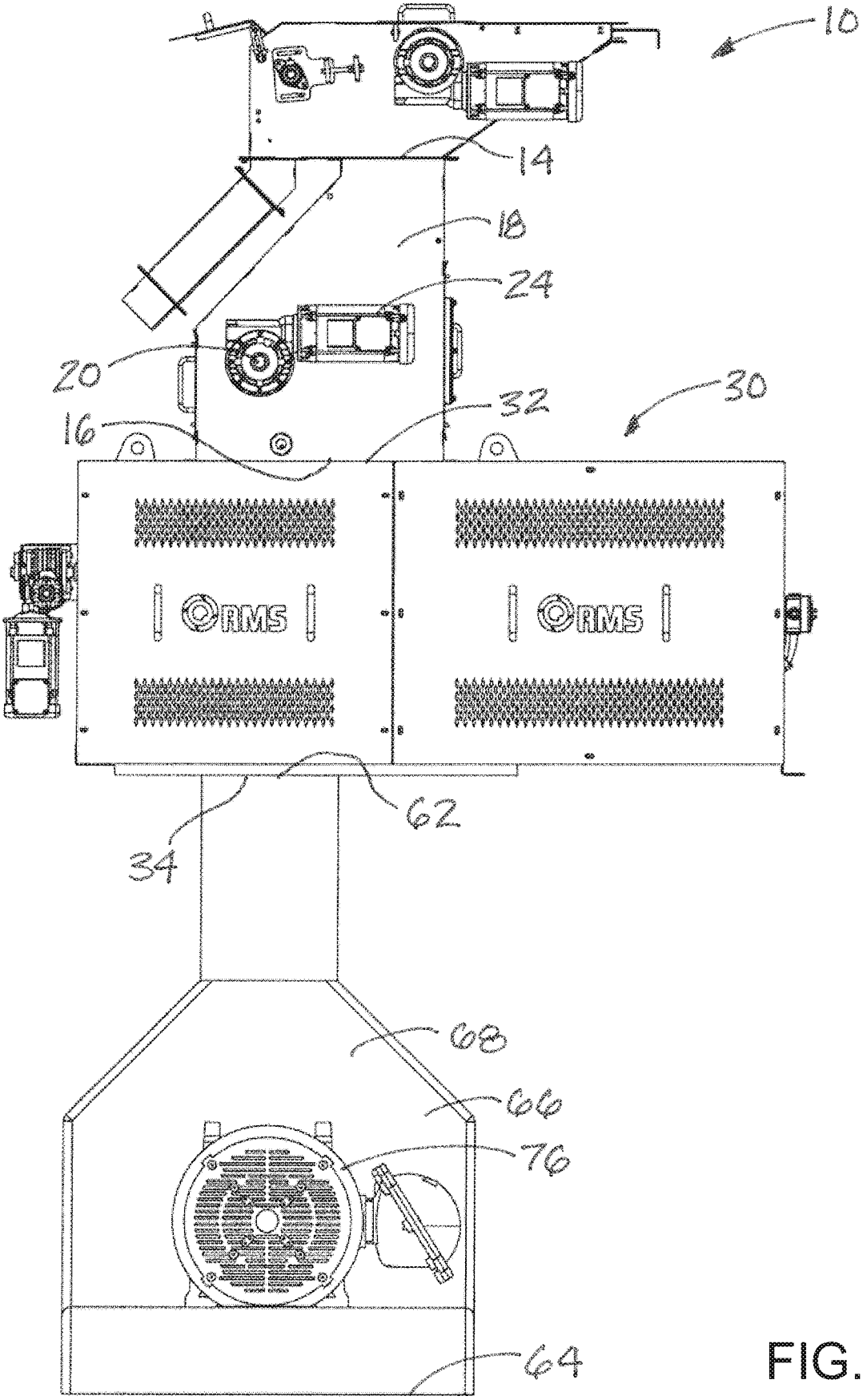
FIG. 7 is a schematic side view of the step grinding apparatus, according to an illustrative embodiment.

In another aspect, the disclosure is directed to a method of grinding a particulate material (see, e.g., FIGS. 5A and 5B). The method may be carried out, for example, at the direction of the control and sensor apparatus executing instructions generally corresponding to the steps or actions of the system elements as set forth in this disclosure. The method may include providing a system which may comprise various elements of the system 10 described in this disclosure. The method may also include setting an initial width of the roll gap 40 between the mill rolls 38, 39 of the roller mill apparatus 30. Setting the width may include setting the width of the roll gap at a minimum width. Illustratively, the minimum width may be a width between approximately 0.001 inches to approximately 1 inch.

The method may also include operating the roller mill apparatus and the hammermill apparatus. Operating the apparatus may include rotating at least one, or both, of the mill rolls 38, 39 of the roller mill apparatus and rotating the rotor 70 and hammers 72 of the hammermill apparatus. The step of operating the apparatus may also include operating the feed apparatus, such as by rotating the rotating shaft 20 and vanes 22 of the feed apparatus. The method may further include feeding particulate material into the roller mill apparatus and the hammermill apparatus, and may include feeding particulate material by the feed apparatus 12 at a predetermined initial feed rate.

The method may include monitoring operation of the roller mill apparatus 30 at the current feed rate, including sensing the power consumption by the roller mill apparatus 30. The sensing step may include sensing the power draw by the roller mill motor or motors by the roller mill power sensor 82, and may include sensing an amperage level of the power draw by the roller mill motors. The monitoring step may also include comparing the sensed power consumption of the roller mill apparatus to a target power consumption for the roller mill apparatus, and may include comparing the sensed amperage level of the power draw to a target amperage level. The target amperage level may be a fractional level of the full load amperage level of the roller mill motor or motors. In some embodiments, the target power consumption may be between approximately 80 percent of the full load amperage and approximately 100 percent of the full load amperage. In one highly advantageous example, the fraction of the full load amperage level is approximately 90 percent of the full load amperage level. A tolerance may be applied to the target amperage level of the roller mill motor such that the comparison is made between the sensed power consumption and a band of levels within a degree of tolerance from the target amperage level. For example, a tolerance of approximately ±5 percent may be applied to the target amperage level, although other tolerances may be utilized. Thus, a band of amperage levels up to approximately 5 percent below the target amperage level and up to approximately 5 percent above the target amperage level may be treated as being substantially equal to the target amperage level.

If it is sensed or otherwise determined that the power consumption of the roller mill apparatus is less than the target power consumption for the roller mill apparatus, then the feed rate of the particulate material to the system, and in particular to the roller mill apparatus, may be adjusted. This action may include increasing the feed rate by a first incremental rate increase such as by increasing the speed of the rotating shaft of the feed apparatus to a sufficient degree to achieve the first incremental rate increase in the feed rate of the particulate material. The step of increasing the feed rate may be repeated by subsequent increases equal to the first incremental rate increase, or to different rate increases.

If the sensed power consumption of the roller mill apparatus is determined to be greater than the target power consumption for the roller mill apparatus, and in particular to the roller mill apparatus, may be adjusted. This action may include decreasing the feed rate by a first incremental rate increase such as by decreasing the speed of the rotating shaft of the feed apparatus to a sufficient degree to achieve the first incremental rate decrease in the feed rate of the particulate material. The step of decreasing the feed rate may be repeated by subsequent decreases equal to the first incremental rate decrease, or to different rate decreases. Optionally, if the sensed power consumption of the roller mill apparatus is determined to be approximately equal to the target power consumption for the roller mill apparatus, then the feed rate of the particulate material into the system may be maintained at the current feed rate for some or all of the subsequent steps.

The method may also include monitoring operation of the hammermill apparatus at the feed rate and the monitoring may include sensing the power consumption by the hammermill apparatus. Sensing the power consumption may include sensing the power draw by the hammermill motor such as by sensing the amperage level of the power draw of the hammermill motor. The monitoring operation may also include comparing the sensed power consumption of the hammermill apparatus to a target power consumption for the hammermill apparatus. This action may include comparing the sensed amperage level of the power draw to a target amperage level for the hammermill apparatus. The target amperage level may be a fractional level of the full load amperage level of the hammermill motor. In some embodiments, the target power consumption may be between approximately 90 percent of the full load amperage and approximately 100 percent of the full load amperage. In one highly advantageous example, the target amperage level for the hammermill motor may be substantially the full load amperage level of the motor, and in some implementations may be substantially the full load after taking into consideration the service factor of the motor. A tolerance may be applied to the target amperage level of the roller mill motor such that the comparison is made between the sensed power consumption and a band of levels within a degree of tolerance from the target amperage level. For example, a tolerance of approximately ±5 percent may be applied to the target amperage level, although other tolerances may be utilized.

If the sensed power consumption of the hammermill apparatus is greater than the target power consumption of the hammermill apparatus, then the width of the roll gap 40 between the mill rolls 38, 39 may be decreased by a predetermined increment and the step of monitoring the operation of the roller mill apparatus, and in particular monitoring the power draw of the roller mill motor or motors, may be repeated.

If the sensed power consumption of the hammermill apparatus is less than the target power consumption of the hammermill apparatus, then the method may include increasing the width or size of the roll gap 40 between the mill rolls 38, 39 by a predetermined increment and then repeating the step of monitoring the operation of the hammermill apparatus, such as the amperage power draw of the hammermill motor, and further action will depend upon the determination of the power draw to the target power draw for the hammermill apparatus. Optionally, if the sensed power consumption of the hammermill apparatus is approximately equal to the target power consumption, then the method may include maintaining the width or size of the roll gap between the mill rolls and repeating the step of monitoring the operation.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that steps set forth in the description and/or shown in the drawing figures may be altered in a variety of ways. For example, the order of the steps may be rearranged, sub steps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A method of grinding a particulate material comprising:

providing a system including a roller mill apparatus and a hammermill apparatus;

operating the roller mill apparatus and the hammermill apparatus;

adjusting a feed rate of particulate material to the roller mill apparatus until power consumption by operation of the roller mill apparatus achieves a target power consumption for the roller mill apparatus; and adjusting a gap between mill rolls of the roller mill apparatus until power consumption by operation of the hammermill apparatus achieves a target power consumption for the hammermill apparatus.

2. The method of claim 1 including monitoring operation of the roller mill apparatus by:

sensing power consumption by the roller mill apparatus, including sensing a power draw by the at least one roller mill motor; and comparing the sensed power consumption of the roller mill apparatus to a target power consumption for the roller mill apparatus.

3. The method of claim 2 wherein:

if the sensed power consumption of the roller mill apparatus is greater than the target power consumption for the roller mill apparatus, then decreasing the feed rate of the particulate material into the system by the feed apparatus; and if the sensed power consumption of the roller mill apparatus is less than the target power consumption for the roller mill apparatus, then decreasing the feed rate of particulate material to the roller mill apparatus.

4. The method of claim 1 including monitoring operation of the hammermill apparatus by:

sensing power consumption by the hammermill apparatus, including sensing a power draw by the hammermill motor of the hammermill apparatus; and comparing the sensed power consumption of the hammermill apparatus to a target power consumption for the hammermill apparatus.

5. The method of claim 4 wherein:

if the sensed power consumption of the hammermill apparatus is greater than the target power consumption of the hammermill apparatus, then increasing the width of the roll gap between the mill rolls; and If the sensed power consumption of the hammermill apparatus is less than the target power consumption of the hammermill apparatus, then decreasing the width of the roll gap between the mill rolls.

* * * * *